US008584382B2

(12) United States Patent
Holzer

(10) Patent No.: US 8,584,382 B2
(45) Date of Patent: Nov. 19, 2013

(54) INSOLE AND SHOE COMPRISING AN ELECTRONIC CHIP

(75) Inventor: Christian Holzer, Munich (DE)

(73) Assignee: Cairos Technologies AG (DE)

( * ) Notice: Subject to any disclaimer, the term of this patent is extended or adjusted under 35 U.S.C. 154(b) by 321 days.

(21) Appl. No.: 12/792,559

(22) Filed: Jun. 2, 2010

(65) Prior Publication Data

US 2011/0296714 A1 Dec. 8, 2011

(51) Int. Cl.
*A43B 23/24* (2006.01)

(52) U.S. Cl.
USPC ..... 36/136; 36/44; 36/137

(58) Field of Classification Search
USPC ..... 36/43, 44, 136, 137
See application file for complete search history.

(56) References Cited

U.S. PATENT DOCUMENTS 5,343,445 A * 8/1994 Cherdak ..... 368/10
5,373,651 A * 12/1994 Wood ..... 36/114
7,607,243 B2 * 10/2009 Berner et al. ..... 36/136
8,028,443 B2 * 10/2011 Case, Jr. ..... 36/132
2001/0049890 A1 12/2001 Hirsch et al.
2005/0261609 A1 11/2005 Collings et al.
2006/0117610 A1 * 6/2006 Silvestri ..... 36/136
2007/0011919 A1 * 1/2007 Case ..... 36/132
2007/0033838 A1 * 2/2007 Luce et al. ..... 36/136
2007/0260421 A1 * 11/2007 Berner et al. ..... 702/160
2008/0203144 A1 * 8/2008 Kim ..... 235/105
2011/0314702 A1 * 12/2011 Berner et al. ..... 36/136

FOREIGN PATENT DOCUMENTS

DE 202004012749 U1 11/2004

OTHER PUBLICATIONS

Extended European Search Report mailed Dec. 7, 2010 in related European Patent Application No. 10005748.8, 9 pages.

* cited by examiner

*Primary Examiner* — Marie Patterson
(74) *Attorney, Agent, or Firm* — Workman Nydegger

(57) ABSTRACT

The present invention relates to an insole, in particular for a sports shoe, and shoe comprising an electronic chip. In order to provide a shoe, in particular a sports shoe, with an electronic chip in a more cost efficient way compared to the prior art, wherein the chip can easily be replaced or removed in case of failure or for recycling, the invention provides an insole, in particular for a sports shoe, wherein the insole comprises an electronic chip. The insole may be fitted into any kinds of shoes and may be readily replaced or removed, as is not an inherent part of the shoe.

14 Claims, 2 Drawing Sheets

INSOLE AND SHOE COMPRISING AN ELECTRONIC CHIP

The present invention relates to an insole and a shoe comprising an electronic chip.

For measuring the performance of an athlete, it is necessary to detect a speed profile and a distance achieved by the athlete, which can be accomplished by means of a shoe comprising an electronic chip.

A shoe comprising an electronic chip is known from the document DE 20 2004 012 749 A1. This shoe has an integrated transponder to transmit timing data to external measuring systems. The chip may be cast in the material of the sole at a previously defined point, sewn into the shoe upper portion, e.g. at the top right of the instep, or cast into an intermediate sole or sole insert. In case of a failure of the electronic chip, the chip cannot be removed or replaced without damaging the shoe.

According to the document FR 2 855 725 A, a module comprising a microprocessor is fitted from the outside into the heel portion of a sole of a boot. That solution requires a thick sole and heel portion, respectively. In sports shoes, such as football shoes, the heel portions are not thick enough to accommodate such a module without adversely affecting functionality or wearing comfort of the shoes.

The object of the invention is to provide a shoe, in particular a sports shoe, with an electronic chip in a more cost efficient way compared to the prior art, wherein the chip can easily be replaced or removed in case of failure or for recycling.

In order to solve the aforementioned object, the invention provides an insole, in particular for a sports shoe, said insole comprising an electronic chip. The insole with integrated chip may be fitted into any kinds of shoes and may be readily replaced or removed, as it is not an inherent part of the shoe. This solution is advantageous compared to the prior art in terms of manufacturing and recycling of the shoe and its components. The insole may be embodied as thermo-insole for skiing boots, for example. The chip can be integrated into the insole, so that it is undetachably combined with the insole, or can be detachably combined with the insole in order to be replaceable or removable without affecting the regular function of the insole, whichever is preferable. In the latter case, the chip can be made separately from the insole body, which may prove advantageous in terms of production efficiency. Usually the manufacturers of insoles and electronic chips operate in different fields of technology and have different fields of expertise. By providing standardized interfaces for the chip and an insole body, the production performance can be optimized. In this case, prefabricated chips can be mated with prefabricated insole bodies having different functions, shapes and/or sizes.

Preferred embodiments are claimed in the subclaims.

Preferably, said chip is embodied as a microprocessor and/or an active and/or passive transponder chip. A microprocessor may be suitable for carrying out complex operations. An active transponder chip is operative at any time required. A passive transponder chip requires an external power input, e.g. by means of electromagnetic induction or the like, but can be made very compact in size.

Preferably, said chip is accommodated in a heel portion, in an arch portion and/or in a ball portion of said insole. The position of the chip can be chosen in accordance with specific needs for specific applications.

Preferably, a body of said insole is made by foaming, casting, injection molding, laminating, punching, stamping and/or cutting, wherein said chip is preferably integrally formed or detachably combined with said insole body. The named methods prove to be useful and efficient in mass production. When the chip forms an inherent part of the insole and/or is embedded in the material of said insole, a wearing comfort is not deteriorated by the chip. After forming the insole by foaming, casting, injection molding and/or laminating, the insole may be tailored to its final shape and size by punching, stamping or cutting.

Preferably, said chip is accommodated between different layers of said insole. In this configuration, the chip can be undetachably combined with the insole.

In a preferred embodiment of the invention, said chip or a module comprising said chip is received within a receptacle of the insole. Preferably, the chip or module can be removably fitted into said receptacle. The receptacle may be a recess, indent, concave, hole or the like provided in the insole and may be formed by punching, stamping or cutting the insole. Alternatively, a mold or die for forming the insole may be provided with a male portion or protrusion or an insert for forming the receptacle. Alternatively, a preformed receptacle may be placed into the mold or die for forming the insole prior to the introduction of the material forming the insole, such that the preformed receptacle becomes an inherent part of the insole. The chip or module as well as the receptacle receiving same may have standardized dimensions. Therefore, the chip or module may be fitted into different insoles having different sizes and shapes, and may easily be replaced in case of failure or removed for recycling. As such, the costs for manufacturing the insole can be reduced.

Preferably, said receptacle receives said chip or module comprising said chip from a top side from or a bottom side of said insole. In the first case, the chip or module cannot be detached from the insole when a user wears a shoe provided with the insole and stands on the top side of the insole. When the user takes the shoe off, the chip or module can easily be replaced. In the second case, the chip or module is trapped between the insole and the sole of the shoe. Hence, even in the case the user takes the shoe off, the chip or module cannot be detached.

Preferably, said chip or module comprising said chip fits into said receptacle such that it completely closes, fills and/or seals said receptacle, wherein the surface of chip or module is preferably flush with adjacent surface of the insole. Said receptacle and said chip or module may have complementary shapes. Furthermore, the chip or module may function as a cover of the receptacle and seal the receptacle in watertight fashion so as to prevent sweat or the like from entering. Most preferably, the chip is located on a side of the module facing the receptacle, such that the chip is provided in a watertight environment when the module closes and seals the receptacle. The insole according to this configuration provides a good wearing comfort and secures functionality of the chip over a long period of time.

Preferably, said chip or module comprising said chip and an insole body are substantially made from the same material, preferably from plastic, most preferably from ethylenvinylacetate (EVA), polyurethane (PU) and/or silicone. Such materials offer good damping characteristics and good wearing comfort. However, the chip or module comprising said chip and the insole body can be made from different materials with different viscosity properties and elasticity properties.

Preferably, said insole comprises energy generation means and/or energy storage means powering said chip, preferably a battery, most preferably a button-type battery. An energy generation means in accordance with the present invention may, for example, convert the pumping action the insole undergoes during walking or running into electrical power in order to power the chip. An energy storage means in accordance with the present invention may be a button-type battery, which is flat and consumes little space. Therefore, a wearing comfort is not deteriorated by such type of battery. Preferably, the battery is positioned next to the chip, such that a thickness of the insole can be minimized.

Preferably, said chip and/or the energy generation means and/or the energy storage means is sealed in a watertight fashion. The energy generation means and/or the energy storage means may be accommodated in a watertight receptacle comprising a watertight lining and/or a watertight cover. Further, the energy generation means and/or energy storage means may be positioned on a side of the cover facing the receptacle or on a side of the receptacle facing the cover. Still further, the energy generation means and/or energy storage means may be provided in/on a module comprising the chip and/or may be received in the same receptacle as the chip or module. In this case, the receptacle may comprise a watertight lining and/or a watertight cover, wherein the module may function as a watertight cover of said receptacle.

The object of the invention is also solved by a shoe, in particular a sports shoe, comprising a module provided with an electronic chip, wherein said module is detachably combined with said shoe, wherein said module is inserted and removed through the opening that receives a foot of a user of said shoe. The module comprising the electronic chip may be a retrofit device that can be removably accommodated in a predetermined space within said shoe without being visible from the outside. In case of failure or for recycling, the module can be easily replaced or removed. The module may comprise any one of the features of the module named above.

Preferably, said module can be received in a receptacle of said shoe. The module can be removably fitted into said receptacle without interfering with the foot of the user during use and without deteriorating the wearing comfort of the shoe. The module and the receptacle receiving same may have standardized dimensions. Accordingly, the same module may be fitted into different shoes, and may easily be replaced or removed in case of failure or for recycling. As such, the costs for manufacturing and recycling of shoes furnished with the chip can be reduced. The module and the receptacle may be configured as described above.

Preferably, said receptacle is provided in/on an insole, a lining, a tongue, an instep or a sole of said shoe. The insole may comprise any one of the features of the insole named above.

The object of the invention is also solved by a method of manufacturing an insole comprising an electronic chip, wherein a body of said insole is made by foaming, casting, injection molding, laminating, punching, stamping and/or cutting, wherein the chip is integrally formed or detachably combined with said insole. The insole may comprise any one of the features of the insole named above.

Further preferred embodiments may result from combinations of the aforementioned features.

DETAILED DESCRIPTION OF THE PREFERRED EMBODIMENTS

Figure 1:
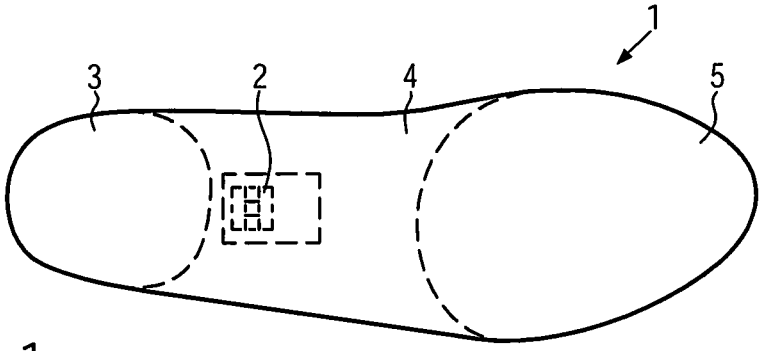
FIG. 1 is a top view of an insole in accordance with the present invention, wherein an electronic chip is integrally formed with a body of the insole and embedded in an arch portion of the insole.

FIG. 1 is a top view of an insole 1 in accordance with a first embodiment of the present invention.

The insole 1 depicted in FIG. 1 is configured for a sports shoe such as a football shoe or a running shoe. For ease of description, only a right insole 1 is depicted and described. The insole 1 may have symmetrical configurations for left and right shoes. The insole 1 has a heel portion 3, an arch portion 4 and a ball portion 5, the portions being designated in accordance with the respective portions of a foot of a user standing thereon in use.

In the first embodiment of the present invention, an electronic chip 2 is integrally formed with the material of the insole 1 and embedded in an arch portion 4 of the insole 1. The chip 2 is embodied as a passive transponder chip that is powered and activated by moving the chip 2 through a magnetic field.

The insole 1 is preferably made by a method comprising the following steps:

In a first step, the chip 2 is positioned in a mold or die for forming the insole 1. The position of the chip 2 in said mold or die may correspond to a position that defines the arch portion 4 of the insole 1.

In a second step, a material forming the body of said insole 1 such as ethylenvinylacetate (EVA), polyurethane (PU) and/or silicone is supplied to said mold or die in a liquid state, such that the chip 2 is fully buried by said material. The insole 1 is preferably made by casting, injection molding or foaming. For foaming, a foaming agent is preferably added to the material prior to the introduction into the mold or die.

In a third step, the material for forming the insole 1 is cured. As such, the chip 2 is embedded in the body of the insole 1 so as to become an inherent part of the insole 1.

In a fourth step, the insole 1 is tailored to its final shape and size by punching, stamping or cutting.

Figure 2:
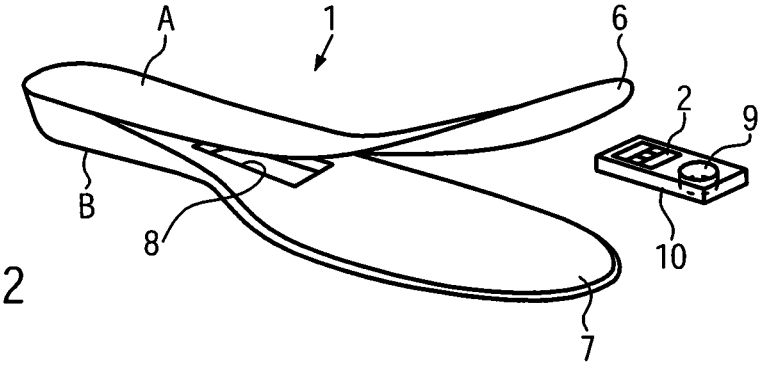
FIG. 2 is a perspective view of an insole in accordance with the present invention, wherein a receptacle for a module carrying an electronic chip and a battery is defined between two layers in an arch portion of the insole.

FIG. 2 is a perspective view of an insole 1 in accordance with a second embodiment of the present invention. In this embodiment, a receptacle 8 for a module 10 carrying an electronic chip 2 and a button-type battery 9 as an energy storage means for powering said chip 2 is defined between two adjacent layers 6, 7 of the insole 1 in an arch portion thereof. The chip 2 is embodied as a microprocessor and/or an active transponder. The battery 9 and the chip 2 are connected by means of flexible conductors. The insole 1 has a top side A and a bottom side B. In use, the top side A faces a foot of a user and the bottom side B faces a sole of a shoe furnished with the insole 1.

The insole 1 is preferably made by a method comprising the following steps:

In a first step, separate layers 6, 7 are made by foaming, casting or injection molding. A material forming the body of said insole 1 such as ethylenvinylacetate (EVA), polyurethane (PU) and/or silicone is supplied to different molds or dies for forming the layers 6, 7. Alternatively, an insole body can be made in one piece by foaming, casting or injection molding in a respective mold or die.

In a second step, a receptacle 8 is formed into the bottom layer 7 by punching, stamping or cutting.

In a third step, the module 10 comprising the chip 2 and the battery 9 is fitted into the receptacle 8 from the top side A of the insole 1, such that the module 10 completely fills, closes and seals the receptacle 8. When the module 10 is completely fitted into the receptacle 8, the surface of the module 10 is flushed with an adjacent surface of the bottom layer 7. That is, the module 10 and the receptacle 8 have complementary shapes, wherein the outer contour of the module 10 is adapted to the inner contour of the receptacle 8.

In a fourth step, the layers 6, 7 are laminated and adhesively connected, so that the module 10 is trapped between the layers 6, 7 and undetachably combined with the insole 1. The laminated layers 6, 7 provide a watertight environment for the module 10.

In a fifth step, the insole 1 is tailored to its final shape and size by punching, stamping or cutting.

Figure 3:
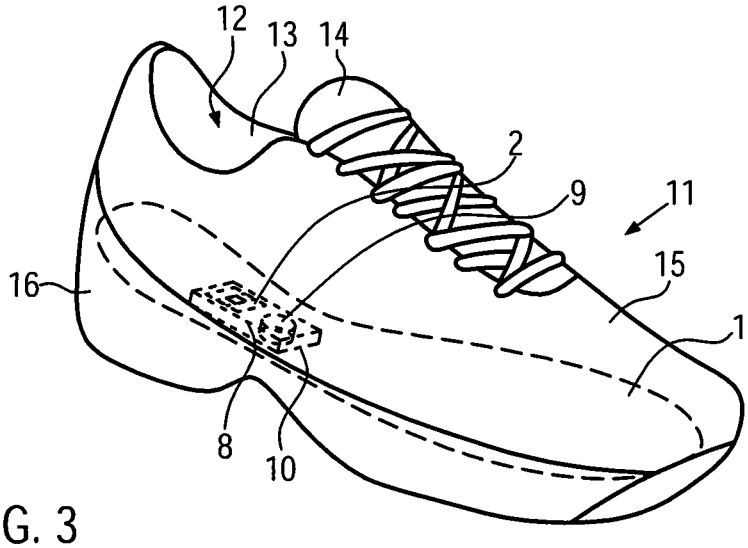
FIG. 3 is a perspective view of a shoe comprising an insole in accordance with the present invention.
Figure 4:
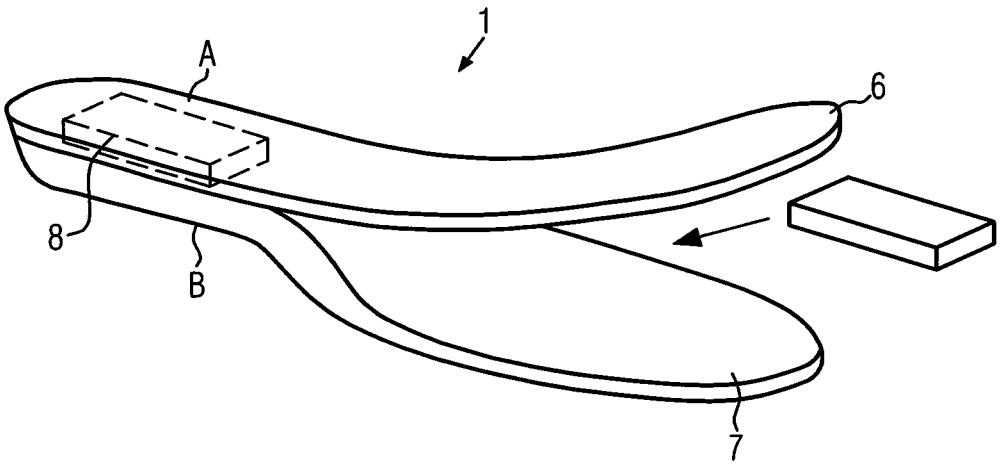
FIG. 4 is a perspective view of an insole in accordance with the present invention.

FIG. 3 is a perspective view of a shoe 11 in accordance with the present invention.

The shoe 11 depicted in FIG. 3 is a sports shoe, in particular a running shoe. For ease of description, only the right shoe is described. The left shoe may be configured likewise in a symmetrical fashion. The shoe 11 comprises an opening 12 that receives a right foot of a user during use, a lining 13, a tongue 14, an instep 15 and a sole 16. A module 10 provided with an electronic chip 2 and a button-type battery 9 as an energy storage means for powering said chip 2 is detachably combined with said shoe 11, wherein the module 10 is inserted and removed through the opening 12. In this embodiment, the module 10 is received in a receptacle 8 provided in an insole 1, preferably in the insole 1 according to the second embodiment. However, the receptacle 8 may alternatively be provided in/on the lining 13, the tongue 14, the vamp 15 or the sole 16.

The invention claimed is:

1. An insole adapted for insertion in a sports shoe, comprising:

a bottom insole layer comprising a receptacle;

a module which carries an electronic chip adapted for measuring certain performance characteristics, said module configured to fit within said receptacle of the bottom insole layer;

a top insole layer which conforms in shape to the bottom insole layer, the top insole layer being adhesively secured to the bottom insole layer and enclosing said module and electronic chip within a watertight environment between the top and bottom layers; and the top insole layer and the bottom insole layer, when adhesively secured with the module with said electronic chip enclosed between said top and bottom layers, forming a single insole member for removable insertion in a sports shoe.

2. An insole as defined in claim 1, wherein said receptacle is formed in one of a heel portion, an arch portion and a ball portion of said insole member.

3. An insole as defined in claim 2, wherein said module further comprises a battery electrically connected to said electronic chip.

4. An insole as defined in claim 3, wherein said electronic chip comprises one of a microprocessor and an active transponder.

5. An insole as defined in claim 2, wherein said electronic chip comprises a passive transponder.

6. An insole as defined in claim 2, wherein said top and bottom insole layers are comprised of one of ethylenvinylacetate (EVA), polyurethane (PU) and silicone.

7. An insole as defined in claim 2, wherein said top and bottom insole layers are made by a process comprised of one of foaming, casting and injection molding.

8. A sports shoe adapted for measuring certain performance characteristics of a person wearing the shoe, comprising:

a shoe comprising an opening that receives a foot of a wearer of the shoe during use, an inner lining, a tongue, and instep and a sole; and a single insole member for removable insertion into said opening, the single insole member configured to rest against and conform to an inner surface of said sole, and the single insole member comprising:

a bottom insole layer comprising a receptacle;

a module which carries an electronic chip adapted for measuring certain performance characteristics, said module configured to fit within said receptacle of the bottom insole layer; and a top insole layer which conforms in shape to the bottom insole layer, the top insole layer being adhesively secured to the bottom insole layer and enclosing said module and electronic chip within a watertight environment between the top and bottom layers.

9. A sports shoe as defined in claim 8, wherein said receptacle is formed in one of a heel portion, an arch portion and a ball portion of said insole member.

10. A sports shoe as defined in claim 9, wherein said module further comprises a battery electrically connected to said electronic chip.

11. A sports shoe as defined in claim 10, wherein said electronic chip comprises one of a microprocessor and an active transponder.

12. A sports shoe as defined in claim 9, wherein said electronic chip comprises a passive transponder.

13. A sports shoe as defined in claim 9, wherein said top and bottom insole layers are comprised of one of ethylenvinylacetate (EVA), polyurethane (PU) and silicone.

14. A sports shoe as defined in claim 9, wherein said top and bottom insole layers are made by a process comprised of one of foaming, casting and injection molding.

* * * * *

UNITED STATES PATENT AND TRADEMARK OFFICE

CERTIFICATE OF CORRECTION

PATENT NO. : 8,584,382 B2
APPLICATION NO. : 12/792559
DATED : November 19, 2013
INVENTOR(S) : Holzer It is certified that error appears in the above-identified patent and that said Letters Patent is hereby corrected as shown below:

In the Specification

Column 2
Line 31, change "top side from or" to --top side or--

Column 5
Line 30, change "vamp 15" to --instep 15--

Signed and Sealed this
Fourth Day of March, 2014

Michelle K. Lee

Michelle K. Lee
*Deputy Director of the United States Patent and Trademark Office*